US010399582B2

(12) United States Patent
Truong et al.

(10) Patent No.: US 10,399,582 B2
(45) Date of Patent: Sep. 3, 2019

(54) ELECTRONIC HORN FOR TRAINS

(71) Applicant: MICRO PRECISION, LLC, South Windham, CT (US)

(72) Inventors: Loi Hong Truong, Surrey (CA); Hui Li, Surrey (CA)

(73) Assignee: MICRO PRECISION, LLC, South Windham, CT (US)

( * ) Notice: Subject to any disclaimer, the term of this patent is extended or adjusted under 35 U.S.C. 154(b) by 78 days.

(21) Appl. No.: 15/338,587

(22) Filed: Oct. 31, 2016

(65) Prior Publication Data

US 2018/0118240 A1 May 3, 2018

(51) Int. Cl.
*B61L 15/00* (2006.01)
*B61L 23/00* (2006.01)
*B61L 25/02* (2006.01)

(52) U.S. Cl.
CPC ..... *B61L 15/0072* (2013.01); *B61L 23/00* (2013.01); *B61L 25/021* (2013.01)

(58) Field of Classification Search
CPC ..... B61L 15/00; B61L 15/0072
See application file for complete search history.

(56) References Cited

U.S. PATENT DOCUMENTS 5,555,815 A * 9/1996 Young ..... A63H 19/14 104/296
2008/0239876 A1* 10/2008 Norris ..... G08B 15/00 367/139
2012/0318932 A1* 12/2012 Parida ..... B61L 23/00 246/473 R
2013/0214097 A1* 8/2013 Graber ..... B61L 29/246 246/174

FOREIGN PATENT DOCUMENTS

WO 2005010838 A1 2/2005

OTHER PUBLICATIONS

International Search Report and Written Opinion for International Application No. PCT/US17/56722 dated Feb. 9, 2018; 14 pgs.

* cited by examiner

*Primary Examiner* — Jason C Smith
(74) *Attorney, Agent, or Firm* — Cantor Colburn LLP

(57) ABSTRACT

An electronic horn for a train includes a microcontroller and a horn configured to provide an audible output sound, the microcontroller configured to provide one or more signals to the horn indicative of a desired audible output sound from the horn. The microcontroller is configured to vary an intensity of the audible output sound from the horn as a function of a speed of the vehicle. The microcontroller is also configured to vary an intensity of the audible output sound from the horn as a function of a period of time within a calendar. Also, the horn includes a horn body and a compression driver, the horn body being mechanically connected with the compression driver. A feedback loop circuit includes the microcontroller and the compression driver, the feedback loop circuit being configured to control an intensity of the audible output sound from the horn.

8 Claims, 4 Drawing Sheets

ELECTRONIC HORN FOR TRAINS

BACKGROUND OF THE DISCLOSURE

The subject matter disclosed herein relates in general to audible warning devices for trains, and in particular to an electronic horn for trains.

Trains have long utilized horns typically mounted on the locomotive to provide an audible warning (e.g., audible output sound, audible sound signal, audible warning sound, audible warning signal, etc.) to pedestrians, animals and vehicles (other than trains) that the moving train is approaching their location—for example, a grade crossing. Regulations exist in most countries with respect to certain aspects of horn usage on trains; for example, a maximum and/or minimum loudness of the horn, and that the horn must be sounded when the moving train is a certain distance from a grade crossing or other locations where pedestrians, animals and/or vehicles may be encountered on or along the railroad tracks. Also, the type or pattern of sound originating from the train horn must be unique and different from that of other vehicles such that no confusion exists as to what type of vehicle (i.e., a train) is providing the sound. Horns may also be used to communicate certain sounds in response to various types of signals given by someone else; for example, during a switching operation.

Known horns for use on trains have utilized primarily air horns—that is, horns which operate through use of compressed air and a diaphragm. However, these types of air horns are somewhat limited in the variety of sounds and functions that they can provide. What is needed is an improved horn for use on a train.

BRIEF DESCRIPTION OF THE DISCLOSURE

According to an embodiment of the present invention, apparatus for use on a vehicle includes a microcontroller and a horn configured to provide an audible output sound, the microcontroller configured to provide one or more signals to the horn indicative of a desired audible output sound from the horn; wherein the microcontroller is configured to vary an intensity of the audible output sound from the horn as a function of a speed of the vehicle.

According to another embodiment of the present invention, apparatus for use on a vehicle includes a microcontroller and a horn configured to provide an audible output sound, the microcontroller configured to provide one or more signals to the horn indicative of a desired audible output sound from the horn; wherein the microcontroller is configured to vary an intensity of the audible output sound from the horn as a function of a period of time within a calendar.

According to yet another embodiment of the present invention, apparatus for use on a vehicle includes a microcontroller and a horn configured to provide an audible output sound, the horn including a horn body and a compression driver, the horn body being mechanically connected with the compression driver; wherein the microcontroller provides one or more electrical signals to the horn indicative of a desired audible output sound from the horn; wherein the compression driver is responsive to the one or more electrical signals from the microcontroller to provide an audible sound as a function of the one or more electrical signals from the microcontroller, the horn body being responsive to the audible sound from the compression driver to provide an amplified sound output that comprises the audible output sound from the horn; and wherein the apparatus further comprises a feedback loop circuit which includes the microcontroller and the compression driver, the feedback loop circuit being configured to control an intensity of the audible output sound from the horn.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

DETAILED DESCRIPTION OF THE DISCLOSURE

Figure 1:
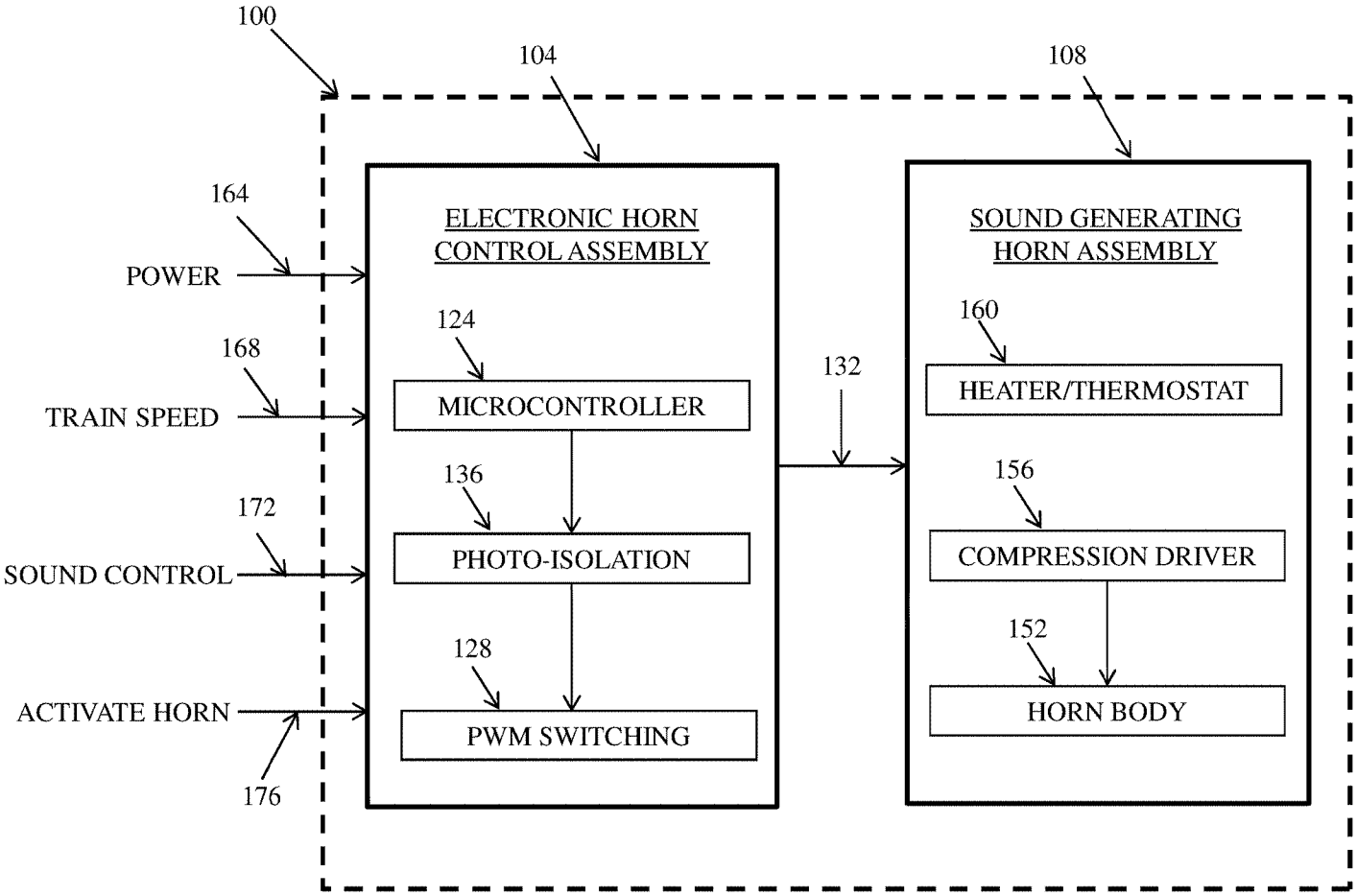
FIG. 1 is a block diagram of an electronic horn for a train according to an embodiment of the present invention.

Referring to FIG. 1, there illustrated is a block diagram of an electronic horn 100 for a train according to an embodiment of the present invention. The electronic horn 100 may comprise two separate assemblies or modules: a first assembly 104 that contains the control electronics for carrying out the majority of functions of the electronic horn (i.e., the "electronic horn control" assembly); and a second assembly 108 that contains the components for generating the audible sound that is output from the electronic horn 100 (i.e., the "sound generating horn" assembly).

Figure 2:
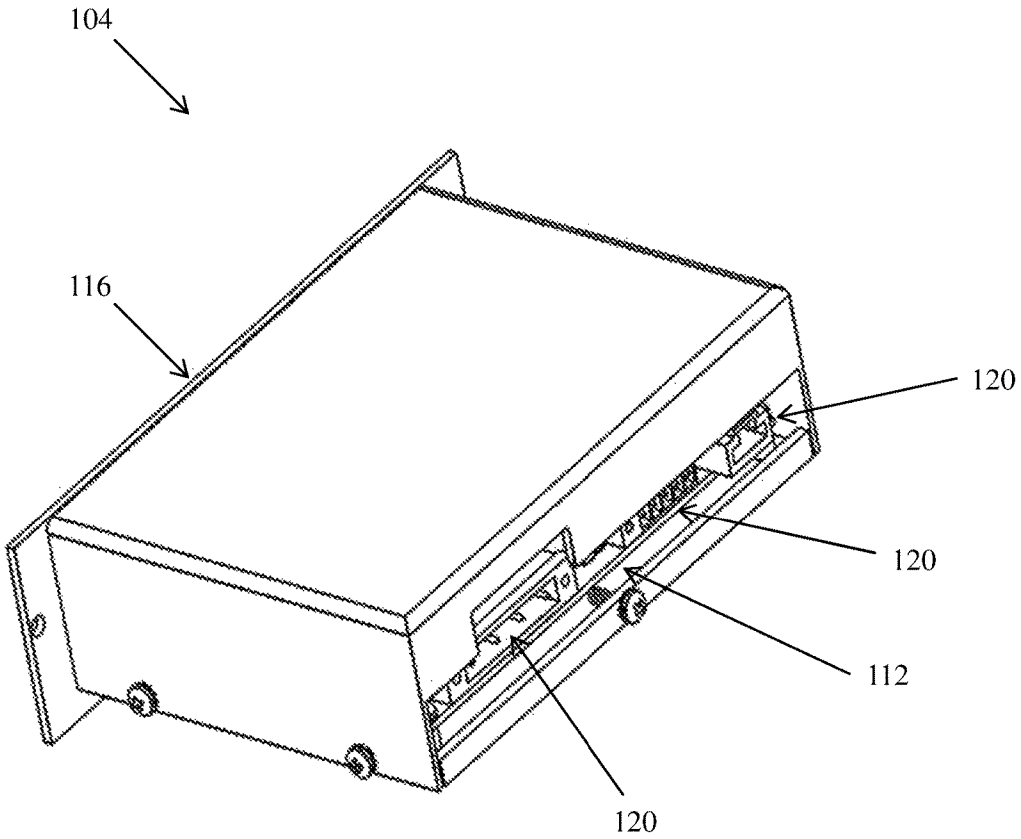
FIG. 2 is an isometric view of the electronic horn control assembly of the electronic horn of FIG. 1 and located inside of an enclosure according to an embodiment of the present invention.

Referring also to FIG. 2, in embodiments of the present invention, the electronic horn control assembly 104 contains a number of electronic and/or other components (e.g., a microcontroller, resistors, capacitors, transistors, diodes, integrated circuits, etc.) that may be mounted on a printed circuit board ("PCB") 112, which itself may reside inside of an enclosure 116. Also shown in FIG. 2 are several connectors 120 (e.g., a USB serial port connector) that are used to connect various signals via wired connections to and from other assemblies, modules or components located in or on the train (e.g., the sound generating horn assembly 108). In the alternative, one or more of the wired connections may be wireless instead. The enclosure 116 may be mounted inside of the locomotive of a train (not shown). As such, the enclosure 116 is not exposed to the relatively harsh environment outside of the train.

FIG. 1 depicts the electronic horn control assembly 104 as including a microcontroller 124 or similar type of digital signal processor which comprises an integrated circuit ("IC") or chip that is mounted to the PCB 112. In exemplary embodiments, the microcontroller 124 may comprise the model PIC24EP64MC204 16-bit microcontroller commercially available from Microchip Technology Inc. As such, the microcontroller 124 includes a number of functions as part of or built in to the microcontroller chip itself, including, for example, memory, an analog-to-digital converter ("ADC"), several input and output ports, high-speed pulse width modulation ("PWM") functionality, several communication interfaces, and a number of timers. However, it should be understood by one of ordinary skill in the art that the use of this specific microcontroller 124 is purely exemplary. Other configurations of a processor and one or more other functional devices (either integrated with the processor on the same IC or chip or separate from the processor) may be utilized in various embodiments of the present invention.

In embodiments of the present invention, a number of the various functions of the electronic horn 100 are embodied in software that is executed by the microcontroller 124, for example, as described in greater detail hereinafter with respect to FIG. 4. As such, the horn functions are digitally controlled. The software may be stored in memory that is a part of the microcontroller 124 chip itself, or may be stored in a separate memory device or chip (e.g., ROM, EEPROM, etc.) that is mounted to the PCB 112. For example the microcontroller 124 can control the tone (e.g., the intensity or loudness, the frequency, and other qualities or characteristics) of the audible output sound from the electronic horn 100.

The electronic horn control assembly 104 of various embodiments of the present invention also includes components that embody a relatively advanced PWM switching topology or circuitry 128. For example, four MOSFET transistors mounted on the PCB 112 may be utilized to generate switched signals that are provided as amplified drive signals on signal lines 132 (e.g., wired cable connections) to the sound generating horn assembly 108, thereby controlling the generation of sound by that assembly 108. Also, in embodiments of the present invention, photo-isolation circuits 136 mounted on the PCB 112 may be connected between the microcontroller 124 and the PWM switching circuitry 128. The photo-isolation circuits 136 may be used to safely isolate the logic circuitry of the microcontroller 124 from the PWM switching circuitry 128.

Figure 3:
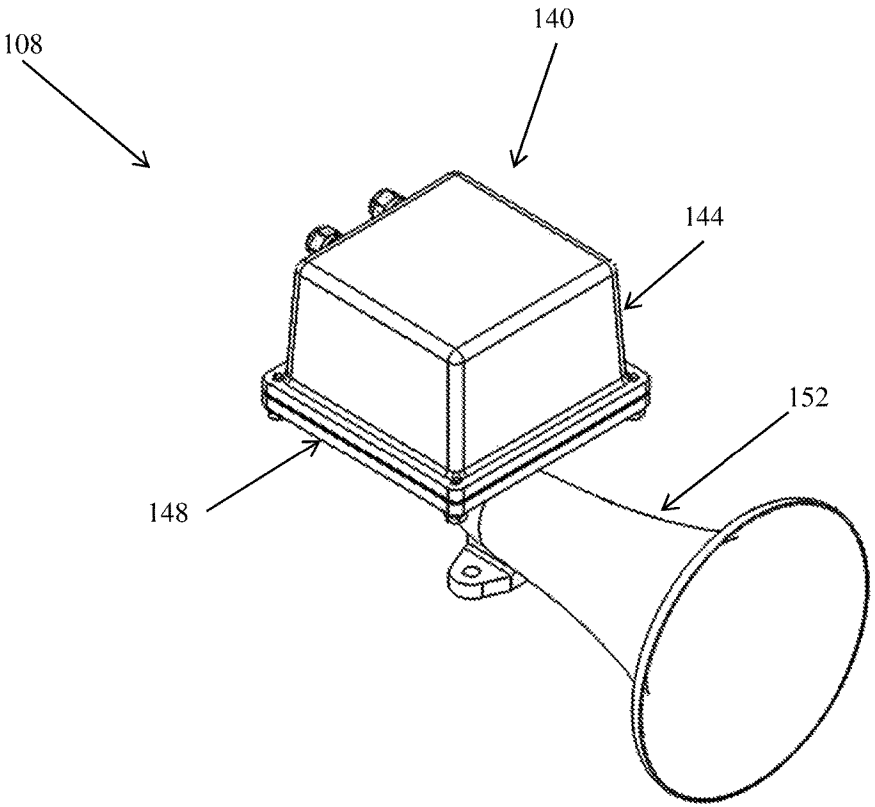
FIG. 3 is an isometric view of the sound generating horn assembly of the electronic horn of FIG. 1 and located inside of an enclosure according to an embodiment of the present invention.

Referring also to FIG. 3, in embodiments of the present invention, the sound generating horn assembly 108 may be mounted inside of a relatively weather proof enclosure 140 that may comprise a cover 144 and a supporting or base plate 148. This is because the enclosure 140 containing the sound generating horn assembly 108 is typically located outside on the locomotive. Thus, it is subject to relatively harsh environmental conditions.

The sound generating horn assembly 108 also includes a compression driver 156 which is responsive to the amplified drive signals on the signal lines 132 from the electronic horn control assembly 104. A housing of the compression driver 156 is typically mechanically connected to the horn or bell body 152. The compression driver 156 converts the electrical energy of the drive signals on the signal lines 132 to sound energy that is output in audible form from the horn or bell body 152. The horn or bell body 152 typically amplifies the sound level provided by the compression driver 156.

The compression driver 156 may be a commercially available electronic siren driver provided by San Ming Electronic Sound Equipment Co., Ltd. As such, the compression driver 156 may provide for a 100 watt maximum power rating, at a maximum total sound output of 133 dB, and in a frequency range of 180-7000 Hz.

In embodiments of the present invention, the sound generating horn assembly 108 may also include a heater and a thermostat 160 located within the enclosure 140. The heater heats the air within the enclosure 140 in relatively cold temperatures with the help of the thermostat to ensure that the compression driver 156 is operated at a proper temperature in relatively cold weather conditions. The thermostat may operate such that it turns on and turns off at preset temperatures; for example, turns on at 40 degrees F. and turns off at 60 degrees F. As shown in FIG. 1, the heater and the thermostat 160 may comprise a standalone device that is separate from any components (e.g., compression driver 156, circuit board, etc.) located within the sound generating horn assembly 108.

Referring again to FIG. 1, the electronic horn control assembly 104 is responsive to various electronic signal inputs or electrical inputs provided from various other locations on the train. For example, electrical power (typically DC voltage and ground) may be provided on the lines 164 to one or both of the electronic horn control assembly 104 and to the sound generating horn assembly 108. In the alternative, the sound generating horn assembly 108 may receive electrical power from the electronic horn control assembly 104 on the signal lines 132.

Also provided to the electronic horn control assembly 104 on a signal line 168 is the current speed of the train. This train speed signal 168 may be utilized in various ways, for example, to control the sound output from the horn or bell body 152, as discussed in greater detail hereinafter. The train speed signal 168 may be provided from the train's speedometer as a DC voltage (e.g., in a range of 1.0-5.0 VDC) or as an electrical current signal in milliamps (e.g., in a range of 4.0-20.0 mA). Further, in the event that train speed signal on the signal line 168 is lost or malfunctioning in some manner, the electronic horn control assembly 104 may assume a fallback position in which a the audible sound output from the horn body 152 may be provided at a minimum loudness value, at a maximum loudness value, or at some other fixed or variable loudness value. The fallback position may be selected by a user, for example, setting a DIP switch or in some other manner.

In addition, a sound control signal on a signal line 172 may be provided to the electronic horn control assembly 104. In an embodiment of the present invention, this signal 172 may be provided by a user via a, e.g., laptop or smartphone, through the USB serial port which is one of the connectors 120 on the PCB 112. In the alternative, the signal 172 may be provided by other electronics located on the train. This sound control signal 172 may be used by the electronic horn 100 to control the tonal output of the audible output sound from the horn or bell body 152.

Still further, a signal on a signal line 176 from a manually operated switch (not shown) may indicate a desire for the electronic horn 100 to provide the audible output sound from the horn or bell body 152. This switch may be a push button, toggle, or some other type of switch that is mounted in the locomotive and operated by a person when it is desired to sound the horn. In the alternative, this activate horn signal on the signal line 176 may be provided by other electronics located on the train; for example, by a train position locating device (e.g., a GPS unit) that senses the geographical position of the train and sounds the horn in response to that position. The position of the train at which the horn may be sounded can include the train being a certain distance from a grade crossing, which may be required by government regulations.

Figure 4:
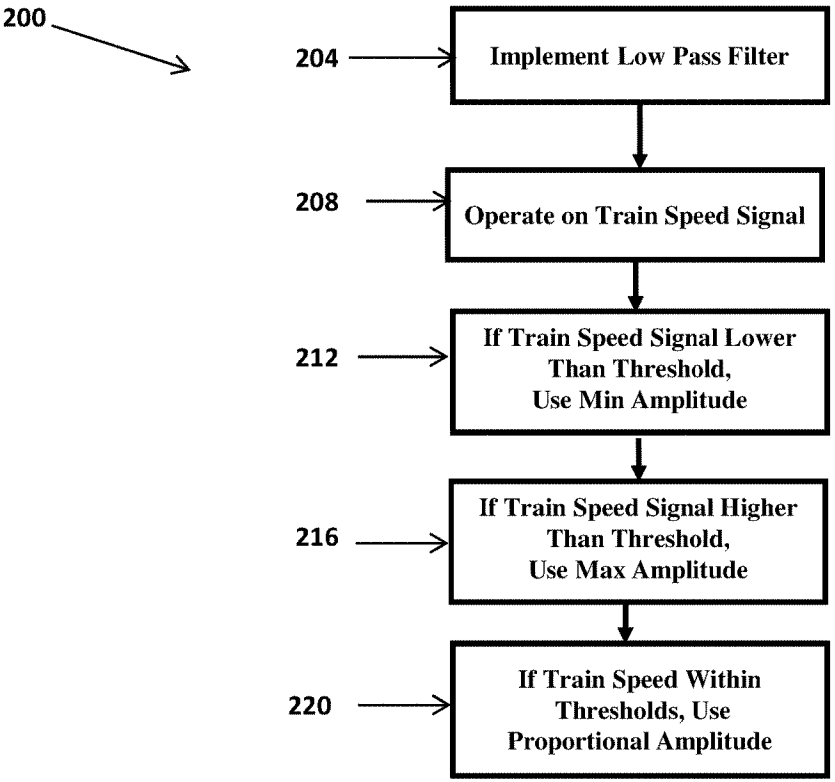
FIG. 4 is a flow diagram of a method for varying the intensity of the audible output sound from the electronic horn as a function of train speed according to an embodiment of the present invention.

Referring to the flow diagram of FIG. 4, according to one aspect of embodiments of the present invention, the output intensity of the audible output sound from the electronic horn 100 may be made to vary as a function of train speed.

FIG. 4 illustrates the operations in a method 200 in accordance with an embodiment of the present invention. More specifically, the microcontroller 124 may execute software that implements a relatively smooth low pass filter. The filter is implemented in an operation in block 204. In an operation in block 208, this filter operates on the train speed signal input on the signal line 168. As such, the intensity of the audible output sound from the horn or bell body 152 may be made to be proportional or disproportional to the train speed for a certain range of speed signal values. The waveform generated by the microcontroller 120 may have a maximum amplitude which can be set by a user by input through the USB serial port, which is one of the connectors 120 shown in FIG. 2.

As the train speed varies from relatively low speed to relatively high speed, the train's speedometer will provide the microcontroller 124 with an analog speed signal on the signal line 168 (FIG. 1) that comprises either a voltage value or a current value. For an electrical current signal, the current value may vary, for example, from 4 mA to 20 mA, wherein 4 mA corresponds to relatively low train speed and 20 mA corresponds to relatively high train speed. When the current value is less than 4 mA, the microcontroller 124 may output a signal to the sound generating horn assembly 108 with a constant output set at, for example, 25% of maximum amplitude (i.e., a "minimum" amplitude signal). Other percentages of maximum amplitude may be utilized, typically depending upon customer needs. This is done in an operation in block 212. In contrast, when the current value is equal to or greater than 20 mA, the microcontroller 124 may output a signal to the sound generating horn assembly 108 with a constant output set at 100% of maximum amplitude (i.e., a "maximum" amplitude signal). This is done in an operation in block 216. Between current values of 4 mA and 20 mA, the microcontroller 124 may output a signal to the sound generating horn assembly 108 having a linear amplitude proportional to the amount of the electrical current value. This is done in an operation in block 220. Thus, it can be seen from the foregoing that the audible output sound from the horn body 152 may be made to vary relatively smoothly (instead of a less smooth, step function variation) in relation to the speed of the train.

If the speed signal on the line 168 from the train's speedometer is an electrical voltage signal (e.g., in a range of 1.0-5.0 VDC) instead of an electrical current signal, a proportional or disproportional analysis similar to that of the electrical current signal may be used.

According to another aspect of embodiments of the present invention, the intensity of the audible output sound from the horn or bell body 152 may be adjusted to different periods of time within a calendar. This may be done, for example, in the field via programming the electronic horn 100 with a computer, smartphone, etc. That is, the sound intensity of the audible output sound from the electronic horn 100 may be set to a calendar by selecting a time period by, e.g., year, month, week, day, hour, minute, and/or second. The microcontroller 124 contains a number of timers, one of which can be used as a real time clock ("RTC") such that the microcontroller 124 will knows the current year, month, week, day, hour, minute, and/or second of operation of the electronic horn 100 of embodiments of the present invention. The RTC may be battery backed up so that the current time is not lost in the event electrical power to the microcontroller 124 is lost. Thus, according to the RTC it is possible to let the microcontroller 124 output different sound intensities for a particular period of time such as a holiday, weekend, or evening.

According to yet another aspect of embodiments of the present invention, the compression driver 156 may be utilized with a feedback loop circuit implemented with the assistance of the microcontroller 124 and other components located on the PCB 112. The feedback loop may be based on the amount of electrical current flowing through the compression driver 156. This allows for relatively precise and efficient control of the output of the compression driver 156.

More specifically, the compression driver contains a permanent magnet and a coil of wire. The microcontroller 124 can continually read the value of the DC power supply voltage, which allows the microcontroller 124 to know how much voltage is being applied to the compression driver 156 through the permanent magnet and the coil within the compression driver 156. The microcontroller 124 also knows the value of the current flowing through the coil. Thus, the microcontroller 124 knows how much power is being output to the compression driver 156. The total output power includes the power consumed by the driver resistance, magnetic loss, and the output sound power which is proportional or disproportional to the output sound intensity. By compensating for the compression driver resistance and magnetic power loss, the microcontroller 124 will know the amount of output sound power, that is, it is equal to the output sound intensity.

Therefore, the microcontroller 124 will be able to control the sound intensity of the audible output sound that is output from the horn or bell body 152 relatively more precisely and also safely, in part because of no excessive or over-current conditions. Additionally, every horn 152 has its own resonant frequency, e.g., 311 or 370 Hz, but from horn to horn that resonant frequency may vary slightly. For example, an actual value for the resonant frequency of the horn 152 may be 375 Hz, The microcontroller 124 may then search for frequencies around this resonant frequency value and may then shift the frequency in a certain range to let the output sound power be maximized, so the system will be more efficient and capable of a greater output sound intensity.

According to still another aspect of embodiments of the present invention, the user may be able to download different horn output sounds to the electronic horn 100 for example, via the USB serial port connector, which is one of the connectors 120. The sounds may be downloaded to the microcontroller 124 and stored in memory.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. An apparatus for use on a vehicle, comprising:

a microcontroller; and a horn configured to provide an audible output sound, the microcontroller configured to provide one or more signals to the horn indicative of a desired audible output sound from the horn;

wherein the microcontroller is configured to vary an intensity of the audible output sound from the horn as a function of a speed of the vehicle; and wherein the microcontroller being configured to vary an intensity of the audible output sound from the horn as a function of a speed of the vehicle comprises the microcontroller being configured to implement a low pass filter that operates on a signal indicative of a speed of the vehicle and to vary an intensity of the audible output sound from the horn in a proportional or disproportional manner as a function of a speed of the vehicle for a certain range of values of the speed of the vehicle, to set an intensity of the audible output sound from the horn at a fixed predetermined minimum value as a function of a speed of the vehicle for a certain range of values of the speed of the vehicle below a certain minimum speed value, and to set an intensity of the audible output sound from the horn at a fixed predetermined maximum value as a function of a speed of the vehicle for a certain range of values of the speed of the vehicle above a certain maximum speed value.

2. Apparatus for use on a vehicle, comprising:

a microcontroller; and a horn configured to provide an audible output sound, the horn including a horn body and a compression driver, the horn body being mechanically connected with the compression driver;

wherein the microcontroller provides one or more electrical signals to the horn indicative of a desired audible output sound from the horn;

wherein the compression driver is responsive to the one or more electrical signals from the microcontroller to provide an audible sound as a function of the one or more electrical signals from the microcontroller, the horn body being responsive to the audible sound from the compression driver to provide an amplified sound output that comprises the audible output sound from the horn; and wherein the apparatus further comprises a feedback loop circuit which includes the microcontroller and the compression driver, the feedback loop circuit being configured to control an intensity of the audible output sound from the horn.

3. The apparatus of claim 2, wherein the microcontroller is configured to search for an actual resonant frequency of the horn and for frequencies near to the resonant frequency of the horn and to shift the frequency in a certain range that allows the audible output sound to attain a maximum value.

4. The apparatus of claim 2, wherein the feedback loop circuit comprises the compression driver including a permanent magnet and a coil of wire, wherein the microcontroller is configured to read a value of a DC power supply voltage to determine an amount of voltage being applied to the compression driver as made by the permanent magnet and the coil of wire, wherein the microcontroller is configured to determine a value of an electrical current flowing in the coil of wire, wherein the microcontroller is configured to determine an amount of electrical power being output to the compression driver to control an intensity of the audible output sound from the horn.

5. The apparatus of claim 4, wherein the microcontroller is configured to determine an amount of electrical power being output to the compression driver by determining a total output power which includes power consumed by a resistance of the compression driver, any magnetic loss in the compression driver, and the output sound power which is proportional or disproportional to the output sound intensity, wherein the microcontroller is configured to compensate for the compression driver resistance and the magnetic power loss to determine an amount of output sound power which is equal to the intensity of the audible output sound from the horn.

6. The apparatus of claim 2, further comprising pulse width modulation switching circuitry connected to the microcontroller, wherein the pulse width modulation switching circuitry is responsive to the one or more electrical signals from the microcontroller indicative of a desired audible output sound from the horn to provide corresponding one or more amplified driver signals to the horn and indicative of a desired audible output sound from the horn.

7. The apparatus of claim 6, further comprising one or more photo-isolation circuits disposed between the microcontroller and the pulse width modulation switching circuitry, wherein the one or more photo-isolation circuits are configured to electrically isolate the microcontroller from the pulse width modulation switching circuitry.

8. The apparatus of claim 2, further comprising an enclosure configured to contain the compression driver, and a heater and a thermostat both disposed within the enclosure, wherein the heater and the thermostat are configured to control a temperature within the enclosure to within one or more preset values.

* * * * *